United States Patent [19]

Nagahara et al.

[11] Patent Number: 5,017,747

[45] Date of Patent: May 21, 1991

[54] MICROSWITCH

[75] Inventors: Toyohiro Nagahara, Shimane; Takashi Niwa, Kyoto; Takezo Sano, Shiga; Isao Kato, Ootsu, all of Japan

[73] Assignee: Omron Tateisi Electronics Co., Kyoto, Japan

[21] Appl. No.: 517,559

[22] Filed: Apr. 27, 1990

[30] Foreign Application Priority Data

Oct. 8, 1987 [JP] Japan ..... 62-254400

[51] Int. Cl.[5] ..... H01H 5/06

[52] U.S. Cl. ..... 200/453; 200/283; 200/402; 200/459; 200/343; 200/335

[58] Field of Search ..... 200/283, 402, 405, 407, 200/430, 450, 453, 456, 458, 459, 468, 451, 454, 457, 343, 341, 335, 332

[56] References Cited

U.S. PATENT DOCUMENTS

| | | | |
|---|---|---|---|
| 2,508,040 | 5/1950 | Ransome | 200/453 |
| 3,030,466 | 4/1962 | Kryder | 200/453 |
| 3,345,476 | 10/1967 | Russell | 200/407 |
| 3,459,912 | 8/1969 | Bauer et al. | 200/452 |
| 3,548,131 | 12/1970 | Piber | 200/451 |
| 4,295,017 | 10/1981 | Kashima et al. | 200/335 |
| 4,486,637 | 12/1984 | Chu | 200/343 |
| 4,613,853 | 9/1986 | Hosogoe et al. | 200/343 |

FOREIGN PATENT DOCUMENTS

| | | | |
|---|---|---|---|
| 0138136 | 4/1985 | European Pat. Off. . | |
| 2430076 | 1/1980 | France . | |
| 2498005 | 7/1982 | France | 200/343 |
| 1136160 | 12/1968 | United Kingdom . | |

*Primary Examiner*—Henry J. Recla
*Assistant Examiner*—Glenn T. Barrett
*Attorney, Agent, or Firm*—Fish & Richardson

[57] ABSTRACT

A microswitch in which a good snap action feeling is obtained and an operating stroke is large is provided. Included in the microswitch is a swingable lever which is pushed by a pressing projection of a push button swingably pivotally supported. One end of the lever is pivotally supported and the other end is coupled with one end of a movable member having a movable contact. The movable member is biased by a spring in one direction.

5 Claims, 5 Drawing Sheets

MICROSWITCH

This application is a continuation of U.S. Pat. application Ser. No. 07/249,651, filed Sept. 27, 1088, now abandoned.

BACKGROUND OF THE INVENTION

1. Field of the Invention

The present invention relates to a microswitch.

2. Prior Art Statement

A typical microswitch is shown in FIG. 1 as one of conventional general microswitches. A switch casing 102 is constructed by a cover 101 and a switch casing main body 103. A terminal member 104 for normally closed contact and a terminal member 105 for normally open contact and a common terminal member 106 are fixed to the main body 103. Fixed contacts 107 and 108 are fixed to inner end portions 104*a* and 105*a* of the fixed terminal members 104 and 105, respectively. A movable contact member 110 is pivotally supported to the inner end portion 106*a* of the common terminal member 106 at the base end thereof. The movable contact member 110 has a movable contact 109 at the front end thereof, the movable contact 109 is brought into contact with or removed from the fixed contacts 107 and 108, respectively. A compression leaf spring 111 is attached between the front end side of the movable contact member 110 and the inner end portion 106*a* of the common terminal member 106. A push button 112 is inserted into a hole 102*a* formed in the top plate of the switch casing 102. By depressing the push button 112, the movable contact member 110 is moved, thereby switching the contacting state of the movable contact 109 from the normally closed type fixed contact 107 to the normally open type fixed contact 108 by the snap action.

However, in such a microswitch, since the movable contact member 110 is directly operated by the push button 112, a degree of whole motion (a travelling amount of the push button 112 from its free position to the operating limit position) is small and its operating stroke amount is also limited to up to about 1 mm.

To solve this problem, means for assuring a large operating stroke is shown in FIG. 2. That is, the push button 112 is operated by an operating lever 113 which is pivotally attached to the switch casing 102. FIG. 3 shows another means for realizing a large operating stroke, in which a sub-button 115 which is pressed downwardly through a spring member 114 is inserted in the push button 112 and the movable contact member 110 is operated by the sub-button 115. However, the former means has a drawback such that a large space is needed for the operating lever 113. The latter means has a drawback such that the number of parts increases.

On the other hand, in any of the foregoing conventional microswitches, their operating characteristics are as shown in FIG. 4 and a load near the operating limit position suddenly increases, so that the good operating feeling cannot be obtained.

SUMMARY OF THE INVENTION

The present invention is made to solve the foregoing inconveniences of the conventional microswitches and it is an object of the present invention to provide a microswitch in which it is small and compact, a large operating stroke can be obtained, and a good operating feeling is derived.

According to the invention, there is provided a microswitch comprising; a switch casing in which a first common terminal member and at least one second terminal member for fixed contact are fixed to a lower base plate portion thereof; a push button having a lever and arranged so as to be pushed into a hole formed in a top plate portion of the switch casing, a front edge side of the lever being pivotally attached to the switch casing; a movable member provided with a movable contact which faces fixed contact fixed to an inner end portion of the second terminal member at a free end portion thereof and arranged so that an inner end portion of the first common terminal member .is freely inserted into an opening formed thereon; a swingable lever swingably pivotally supported to the inner end portion of the first common terminal member at the base end thereof and depressed by the lever of the push button, the base end of the movable member being pivotally attached to a free end portion of the swingable lever; and a substantially U-shaped compression spring one end of which is engaged with the inner end portion side of the first common terminal member and the other end of which is engaged with the free end portion side of the movable member.

According to the present invention, the base end side of the movable member is moved along an arc through the swingable lever which is operated by the push button. Therefore, an increasing rate of the load near the operating limit position is small and a good operating feeling is obtained. Further, since the front edge of the lever of the push button is pivotally attached to the switch casing, the operating stroke ca be increased although this switch mechanism is small. In particular, since the pivotal supporting portion of the front edge of the push operating lever of the push button is restricted, there is an advantage such that the stable operation can be derived.

DETAILED DESCRIPTION OF PREFERRED EMBODIMENT

An embodiment of the present invention will be described hereinbelow with reference to the drawings.

Figure 1:
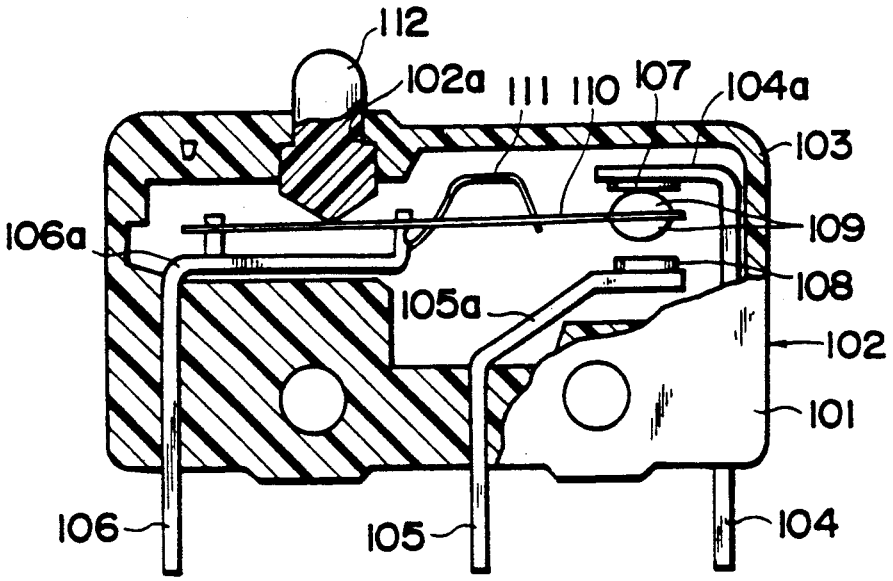
Fig. 1 PRIOR ART
FIG. 1 is a front view with a part cut away showing a conventional microswitch.
Figure 4:
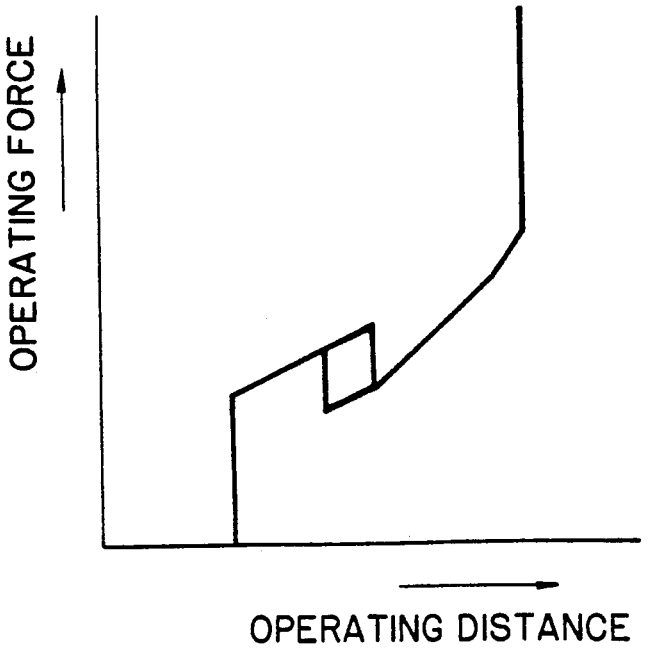
Fig. 4 PRIOR ART
FIG. 4 is a characteristic graph showing the relation between the operating distance and the operating force in a conventional microswitch.
Figure 2:
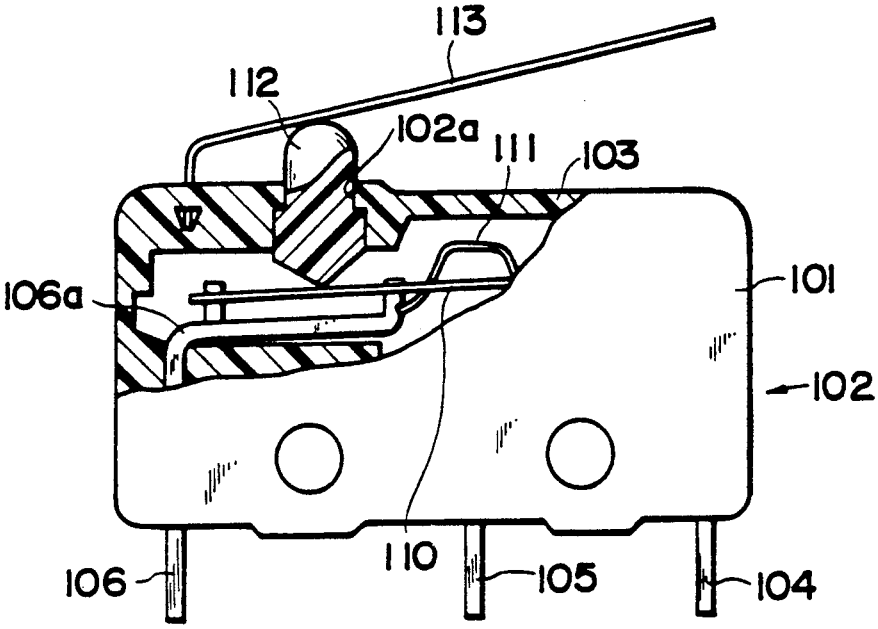
Fig.2 PRIOR ART
FIGS. 2 and 3 are front views with parts cut away showing conventional microswitches having different operating stroke enhancing means.
Figure 3:
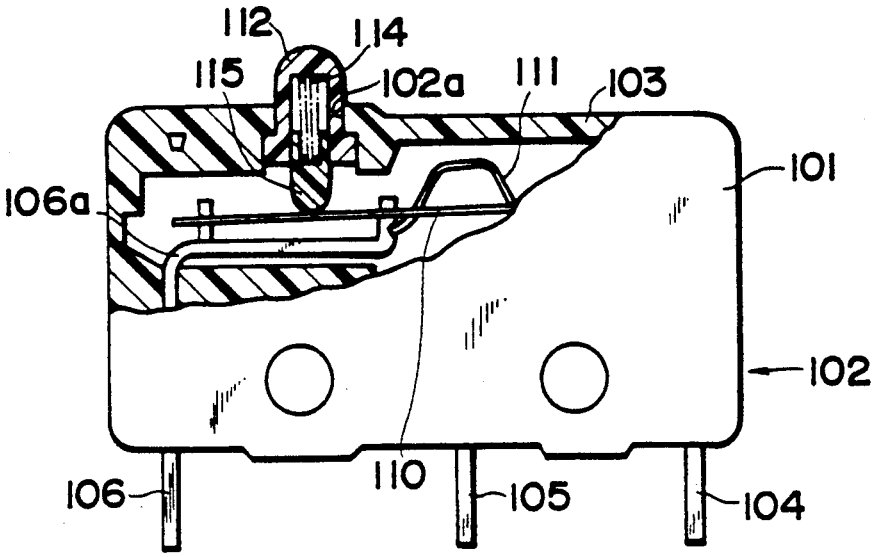
Fig.3 PRIOR ART
Figure 5:
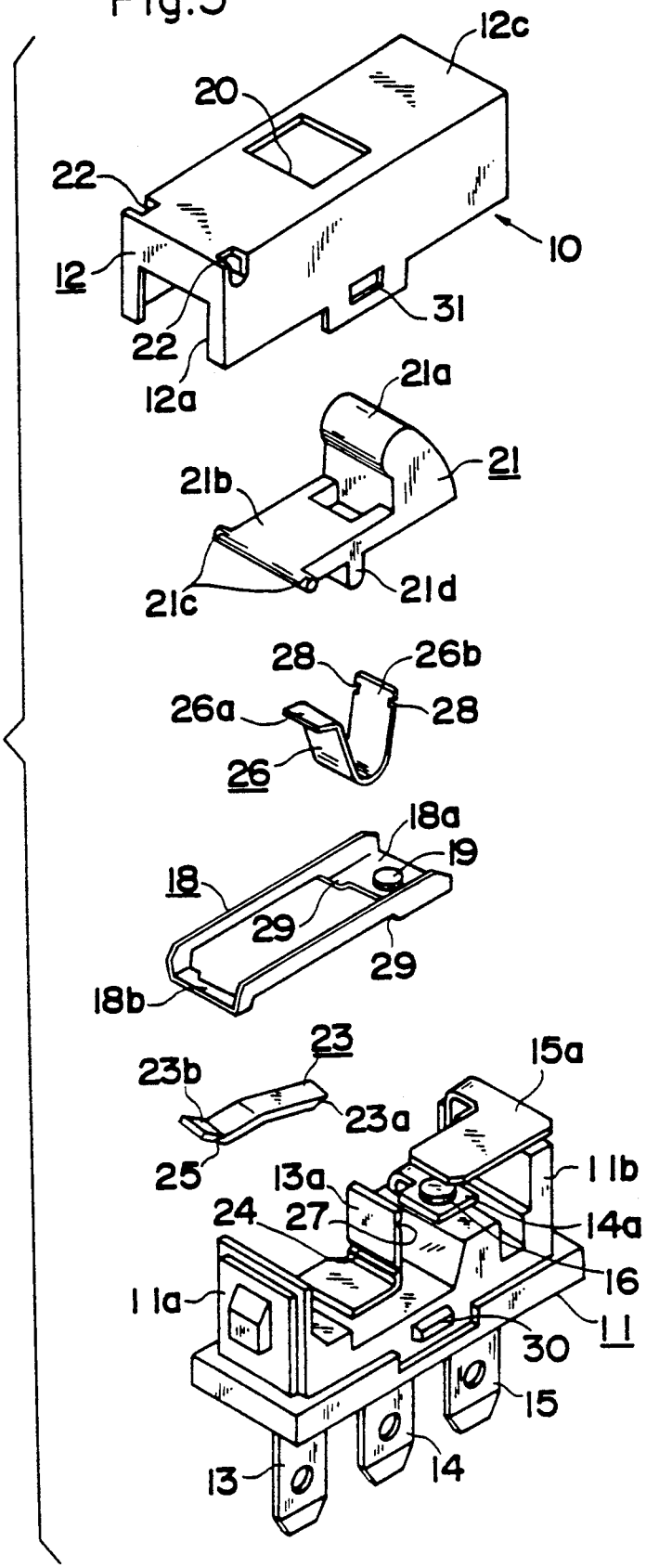
FIG. 5 is an exploded perspective view showing an embodiment of a microswitch according to the present invention.
Figure 6A:
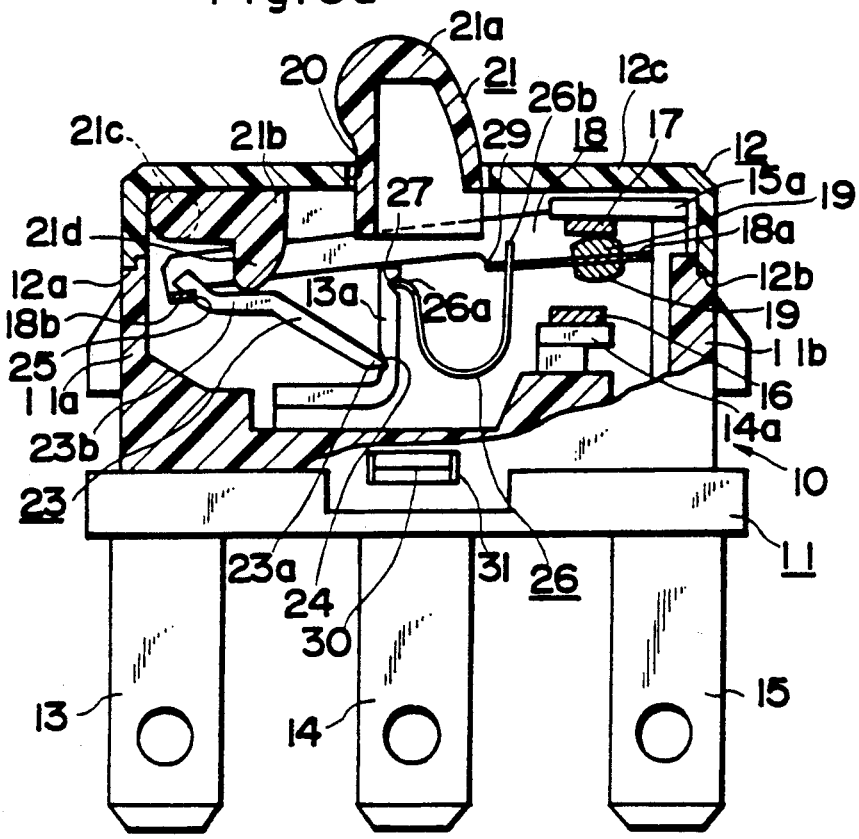
FIGS. 6*a* and 6*b* are front cross sectional views with parts cut away showing the microswitch of FIG. 5 in the OFF and ON states, respectively.
Figure 6B:
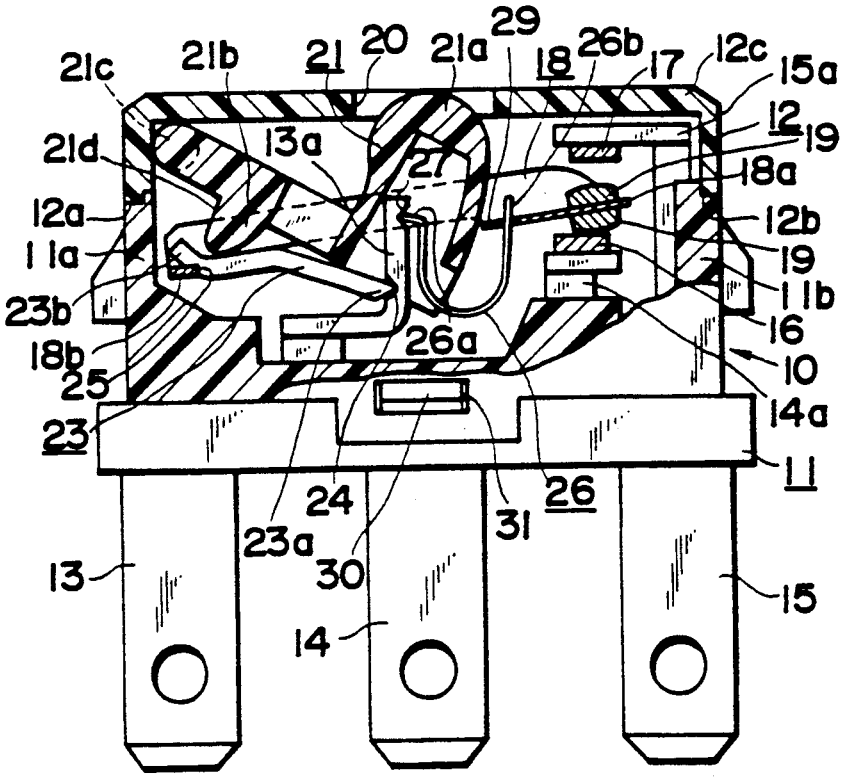

FIG. 5 is an exploded perspective view showing an example of a microswitch according to the invention. Figs. 6*a* and 6*b* are front cross sectional views with parts cut away showing the microswitch in the OFF and ON states, respectively.

In the diagrams, a switch casing 10 is constructed by a terminal base 11 and a cover 12. The terminal base 11 is made of a plate-shaped synthetic resin having an electrical insulating property and constructs a lower wall portion of the switch casing 10 Vertically projecting portions 11*a* and 11*b* are formed on both of the left and right end portions of the terminal base 11, respectively The cover 12 is attached onto the terminal base 11. Notched portions 12*a* and 12*b* adapted to be come into engagement with the vertically projecting portions 11*a* and 11*b* are formed by being cut away in both of the left and right end portions of the cover 12 made of a synthetic resin, respectively.

A common terminal member 13 whose inner end portion 13*a* is located at almost the central position in the lateral (right/left) direction is fixed to the terminal base 11. A terminal member 14 for normally open contact and a terminal member 15 for normally closed contact are also fixed to the terminal base 11. Inner end portions 14*a* and 15*a* of the terminal members 14 and 15 are bent from the, lower and upper directions so as to face each other on the right end side of the terminal base 11. Fixed contacts 16 and 17 are fixedly attached onto the opposite surfaces of the inner end portions 14*a* and 15*a* so as to face each other, respectively.

A movable member 18 is formed so as to have a substantial long frame shape having a large opening and is made of a conductive material. The movable member 18 is arranged so as to ride over the inner end portion 13*a* of the common terminal member 13 in the lateral (right-/left) direction, that is, in a manner such that the inner end portion 13*a* loosely enters the opening formed in the movable member 18. A movable contact 19 which respectively faces the fixed contacts 16 and 17 is fixed to a free end portion 18*a* consisting of a right end coupling member.

A hole 20 is formed in a top plate 12*c* of the cover 12 at an almost central position in the lateral direction. A push button 12 made of a synthetic resin is also provided. This push button 21 is constructed by an operational member portion 21*a* and a lever portion 21*b*. The operational member portion 21*a* is inserted into the hole 20 so that it can be depressed. On the other hand, fulcrum rod portions 21*c* are formed at a front edge of the lever portion 21*b* so as to be projected in the front-to-back direction. The fulcrum rod portions 21*c* are rotatably pivotally supported into recesses 22 formed in the front and rear inner walls on the upper leftmost side of the cover 12, respectively.

An almost S-shaped swingable lever 23 is provided in the switch casing 10. A first pivotally supporting groove 24 is formed on the surface on the left side of the inner end portion 13*a* of the common terminal member 13. A base-sided edge portion 23*a* comes into engagement with the first pivotally supporting groove 24 and is rotatably pivotally supported. On the other hand, a second pivotally supporting groove 25 is formed on the lower surface of a free end portion 23*b* of the lever 23. A base end portion 18*b* of the movable member 18 is come into engagement with the second pivotally supporting groove 25 and is pivotally supported. The swingable lever 23 is operated by a pressing projection 21*d* formed on the lower surface of the lever 21*b*.

A compression spring 26 is formed substantially into a U-shape from a leaf spring made of a conductive material. A left edge portion 26*a* is bent to the left and is come into engagement with and is pivotally supported to a lateral groove 27 formed on the surface on the right side of the inner end portion 13*a* of the common terminal member 13. A notched portion 28 formed in a right edge portion 26*b* comes into engagement with an engaging projection 29 formed on the side of the free end portion 18*a* of the movable member 18, thereby applying a return spring force to the movable member 18. The movable member 18 is electrically connected to the common terminal member 13 through the compression spring 26. The movable member 18 and common terminal member 13 can be also electrically connected through the swingable lever 23.

Engaging projections 30 are formed on both of the front and rear walls of the terminal base 11. Engaging holes 31 are formed in both of the front and rear walls of the cover 12 and come into engagement with the engaging projections 30 when the cover 12 is attached onto the terminal base 11.

The operation of the foregoing structure will now be described.

When the operational member portion 21*a* of the push button 21 is pushed from a position of FIG. 6*a*, the lever portion 21*b* rotates clockwise around the fulcrum rod portions 21*c* (22) serving as the fulcrum supporting portion as a rotational center. The free end portion 23*b* of the swingable lever 23 is rotated counterclockwise by being pressed by the pressing projection 21*d* around the base-sided edge portion 23*a* (24) serving as the fulcrum supporting portion as a rotational center. Therefore, the base end portion 18*b* of the movable member 18 is depressed downwardly. When the base end portion 18*b* (25) serving as the fulcrum supporting portion of the movable member 18 and swingable lever 23 exceeds a change point which is determined by the position of the left edge portion 26*a* (27) serving as the fulcrum supporting portion of the inner end portion 13*a* of the common terminal member 13 and the compression spring 26, the movable contact 19 is removed from the normally closed type fixed contact 17 by the snap action due to the force of the compression spring 26 as shown in FIG. 6*b*. Thus, the movable contact 19 comes into contact with the normally open type fixed contact 16, thereby electrically connecting the common terminal member 13 and terminal member 14 for normally open contact.

When the operation to depress the operational member portion 21*a* of the push button 21 is stopped in the state of FIG. 6*b*, the lever portion 21*b* rotates counterclockwise around the fulcrum rod portions 21*c* (22) serving as the fulcrum supporting portion as a rotational center, so that the free end portion 23*b* of the swingable lever 23 rotates clockwise. Thus, the movable contact 19 is operation opposite to that mentioned above, thereby electrically connecting the terminal member 15 for normally closed contact and the common terminal member 13.

Figure 7:
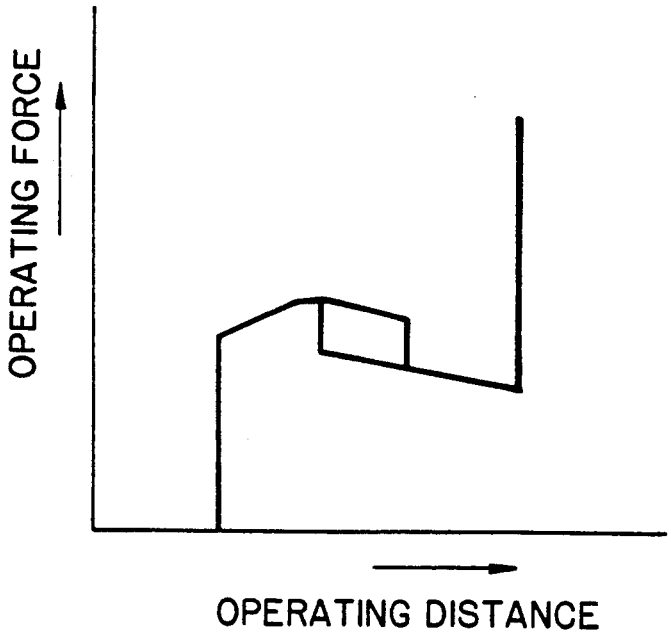
FIG. 7 is a characteristic graph showing the relation between the operating distance and the operating force in the microswitch of FIG. 5.

The depressing operation of the push button 21 is propagated to the movable member 18 through the swingable ever 23, thereby allowing the base end portion 18*b* of the movable member 18 to be moved along an arc. Therefore, an operating characteristic as shown in FIG. 7 is obtained. That is, the change ratio of the depressing force with respect to the operating distance near the operating limit position is small and the good operating feeling can be obtained.

Further, the fulcrum rod portions 21*c* formed at the edge of the lever portion 21*b* of the push button 21 is pivotally supported into the recesses 22 on the side of the switch casing 12 and the pressing projection 21*d* is located between the operational member portion 21*a* and the fulcrum rod portions 21*c*. Therefore, the operating stroke is enhanced by the lever portion 21*b*. Thus, although this switch mechanism is small, a large operating stroke of, e.g., 3 mm or more can be easily obtained. Moreover, since the front edge side of the lever portion 21*b* is pivotally supported to the cover 12 of the switch casing 10, there is an advantage such that the depressing operation of the push button 21 is restricted by the fulcrum supporting portions 21*c* (22) of the lever portion 21*b* and is stabilized.

Although the above embodiment has been described with respect to the example in which a pair of terminal members 14 and 15 for fixed contact have been provided, the invention can be also applied to a construction having one terminal member for fixed contact.

What is claimed is:

1. A microswitch comprising:

a switch casing having a lower base plate portion and a top plate portion a first common terminal member and at least one second terminal member disposed within said switch casing and fixed to said lower base plate portion, said at least one second terminal member having a fixed contact fixed to an inner end portion thereof;

a swingable lever having a base end and a free end portion, said base end being pivotally supported by an inner end portion of said first common terminal member;

a movable member having a base end and a free end portion, said base end being pivotally attached to the free end portion of said swingable lever and said free end portion being provided with a movable contact which faces said fixed contact;

a substantially U-shaped compression spring, one end of which is engaged with the inner end portion of said first common terminal member and the other end of which is engaged with the free end portion of said movable member; and a push button comprising:

a lever portion disposed beneath the top plate portion of the switch casing, a fulcrum portion disposed at one end of the lever portion and pivotally attached to an interior portion of the switch casing, an operational member portion disposed on the lever portion and extending through a hole a formed in the top plate portion of the switch casing, and pressing means disposed on the lever portion for pressing the swingable lever, wherein said substantially U-shaped compression spring has a depression formed therein which opens toward said operational member portion; and wherein said operational member portion is formed with a recess opening toward said substantially U-shaped compression spring;

such that when said push button is depressed, an end of said push button enters the depression formed in said substantially U-shaped compression spring and an end of said substantially U-shaped compression spring enters the recess formed in said operational member portion.

2. A microswitch according to claim 1, wherein two second terminal members are provided and wherein said second terminal members are arranged on opposite sides of said movable contact of said movable member and electrically connectable therewith.

3. A microswitch according to claim 1, wherein the inner end portion of the first common terminal, the inner end portion of the second common terminal, the swingable lever, and the movable member are located in a common plane, and wherein the swingable lever extends from the inner end portion of the first common terminal in a direction away from the second common terminal.

4. A microswitch according to claim 1, wherein the pressing means comprises a laterally extending pressing portion.

5. A microswitch according to claim 1, wherein the movable member has an opening into which said operational member portion of said push button enters when said push button is depressed.

* * * * *